United States Patent [19]

Maldonado

[11] Patent Number: 5,042,691

[45] Date of Patent: Aug. 27, 1991

[54] DUAL LIQUID CARTRIDGE DISPENSER

[75] Inventor: John E. Maldonado, San Antonio, Tex.

[73] Assignee: Scott Paper Company, Philadelphia, Pa.

[21] Appl. No.: 467,370

[22] Filed: Jan. 19, 1990

Related U.S. Application Data

[63] Continuation-in-part of Ser. No. 269,620, Nov. 10, 1988, Pat. No. 4,895,276, which is a continuation of Ser. No. 110,151, Oct. 19, 1987, abandoned.

[51] Int. Cl.[5] ..... B67D 5/60

[52] U.S. Cl. ..... 222/144.5; 222/185

[58] Field of Search ..... 222/144.5, 129, 214, 222/213, 182, 185, 181, 207; 251/4, 6, 7, 9; 417/477

[56] References Cited

U.S. PATENT DOCUMENTS

| | | | |
|---|---|---|---|
| 3,193,143 | 7/1965 | Maieli | 222/144.5 |
| 3,679,331 | 7/1972 | Kushner | 417/477 |
| 4,130,224 | 12/1978 | Norman et al. | 222/185 |
| 4,513,885 | 4/1985 | Hogan | 222/185 |
| 4,895,276 | 1/1990 | Maldonado | 222/144.5 |

*Primary Examiner*—Robert P. Olszewski
*Assistant Examiner*—Kenneth Noland
*Attorney, Agent, or Firm*—Mark G. Bocchetti; John W. Kane, Jr.

[57] ABSTRACT

A dual cartridge dispenser. Each cartridge has an exit orifice through which fluid is dispensed when a tube of the cartridge is compressed. A dispensing lever is manually displaceable by a user to compress the tube. A movable compression member is adjustably mounted to the dispsensing lever so as to be selectively located at a first position adjacent the pump portion of the second cartridge. A knob extending outside the dispenser is connected to the compression member for moving the compression member to the first position or to the second position to thereby select the cartridge to be dispensed from. When the dispensing member is operated, it causes only the tube that is adjacent the compression member to be compressed between the compression member and an opposed pinch surface in the dispenser.

10 Claims, 9 Drawing Sheets

DUAL LIQUID CARTRIDGE DISPENSER

RELATED INVENTIONS

This is a Continuation-In-Part of U.S. application Ser. No. 07/269,620, filed Nov. 10, 1988, now U.S. Pat. No. 4,895,276, issued Jan. 23, 1990, which is a Continuation of U.S. application Ser. No. 07/110,151, filed Oct. 19, 1987 and now abandoned.

TECHNICAL FIELD

This invention relates to viscous liquid dispensers and, in particular, to a dispenser containing at least two disposable cartridges of the viscous liquid with means for selectively dispensing only from a single cartridge at any one time.

BACKGROUND ART

Within the past ten years, it has become fairly common to package certain viscous liquids, such as soaps, shampoos and like products, in disposable cartridges and to dispense such liquids from dispensers in places like public washrooms, and hotel and motel bathrooms. Although the detailed construction of the disposable cartridges may differ, they generally include a compressible pump portion and an exit orifice for the liquid. When pressure is applied to the pump portion of the cartridge, liquid is forced through the exit orifice, into the user's hand. The dispensers that accept such disposable liquid cartridges have a manually operated dispensing member, such as a pivoted lever, for pressing the pump portion of the cartridge against a compression surface in the dispenser. A typical prior art viscous liquid dispenser is disclosed in Norman et al. U.S. Pat. No. 4,130,224, assigned to the assignee of the present invention. The dispenser disclosed in that patent is used to dispense liquids such as soap from a single disposable cartridge. The dispenser has a sight window located adjacent to the bottom of the disposable cartridge so that a maintenance person can see that the cartridge needs to be replaced. One problem with the single cartridge dispenser is that when the maintenance person looks at the window, the level of the fluid may be only slightly above the window with the result that the cartridge is completely used up before the maintenance person returns to service the dispenser. Another common occurrence is that if the maintenance person observes that the liquid level in the cartridge is just below the top edge of the sight port, the maintenance person may replace the cartridge rather than take the chance that the cartridge will empty before the dispenser is next serviced. This, of course, can lead to a considerable waste of the liquid soap or other product. Thus, it would be desirable to have a dispenser that holds two disposable cartridges so that the user can completely exhaust one cartridge and then begin immediately dispensing from the second cartridge.

One approach for dispensing from two cartridges is suggested by Hogan U.S. Pat. No. 4,513,885 which discloses packaging two single cartridge dispensers side by side to form a dispensing system. One problem with adopting this concept for a liquid soap dispenser is that since the user can dispense from either dispenser it is possible for both cartridges to empty at the same time. Thus, it can be seen that it would be desirable to have a dual cartridge dispensing system which prevents the user from dispensing from one cartridge until the other cartridge is completely empty.

Dalrymple U.S. Pat. No. 2,619,386 discloses a trigger operated spray gun for simultaneously spraying two liquid solutions onto an object. At column 5, lines 49–68, Dalrymple describes a trigger operated mechanism that simultaneous opens or closes a pair of fluid passages. At column 6, lines 33–40, Dalrymple provides for individual adjustment of the fluid flow through each fluid passageway.

It is an object of this invention to provide a dispenser for two or more disposable, viscous liquid cartridges wherein the probability that the dispenser will empty before it can be serviced is greatly reduced.

Another object of this invention is to provide a dispenser, having two disposable liquid cartridges, that can only dispense from one cartridge at a time.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawing in which:

Figure 4:
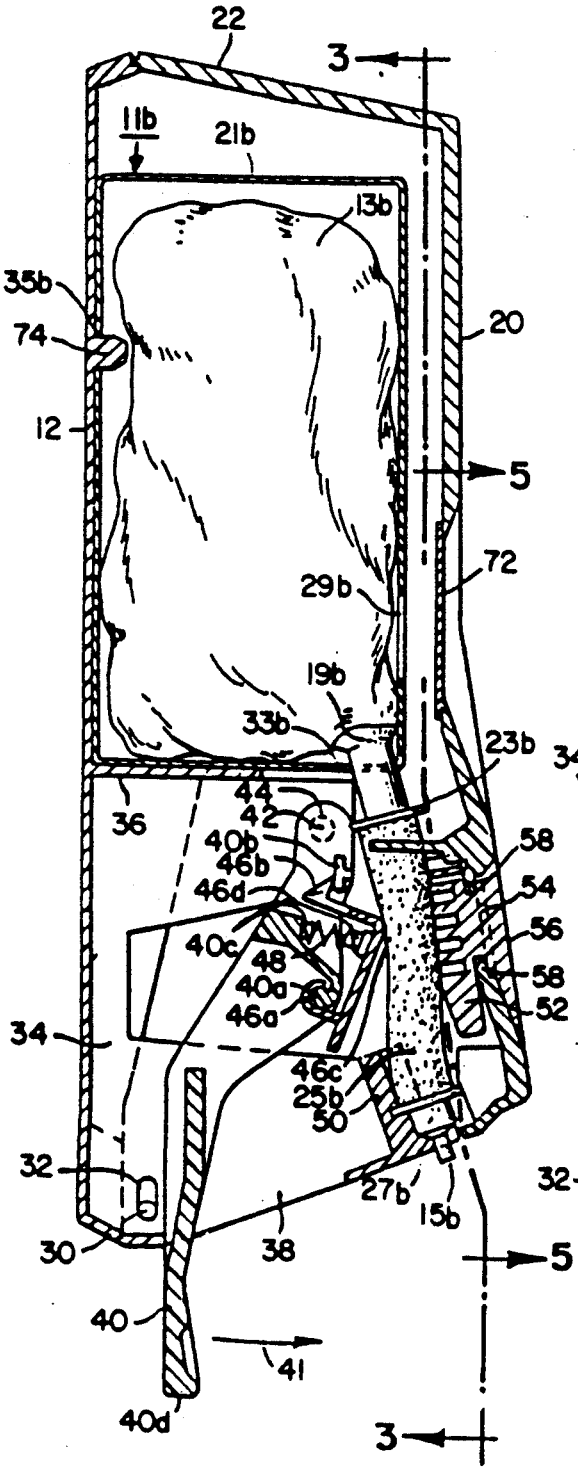
FIG. 4 is a sectional side elevation view taken along the line 4—4 of FIGS. 2 and 3.
Figure 6:
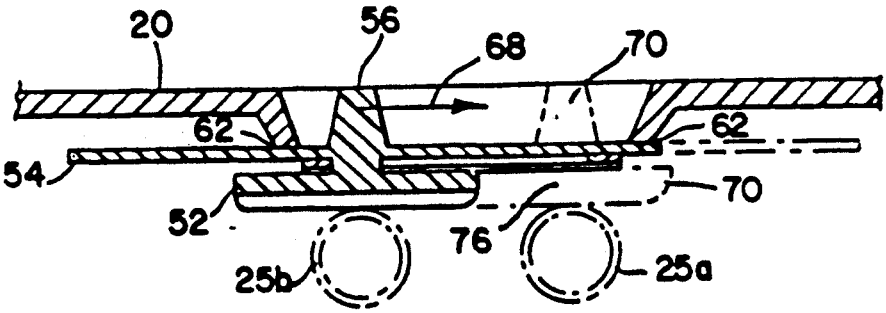
Figure 5:
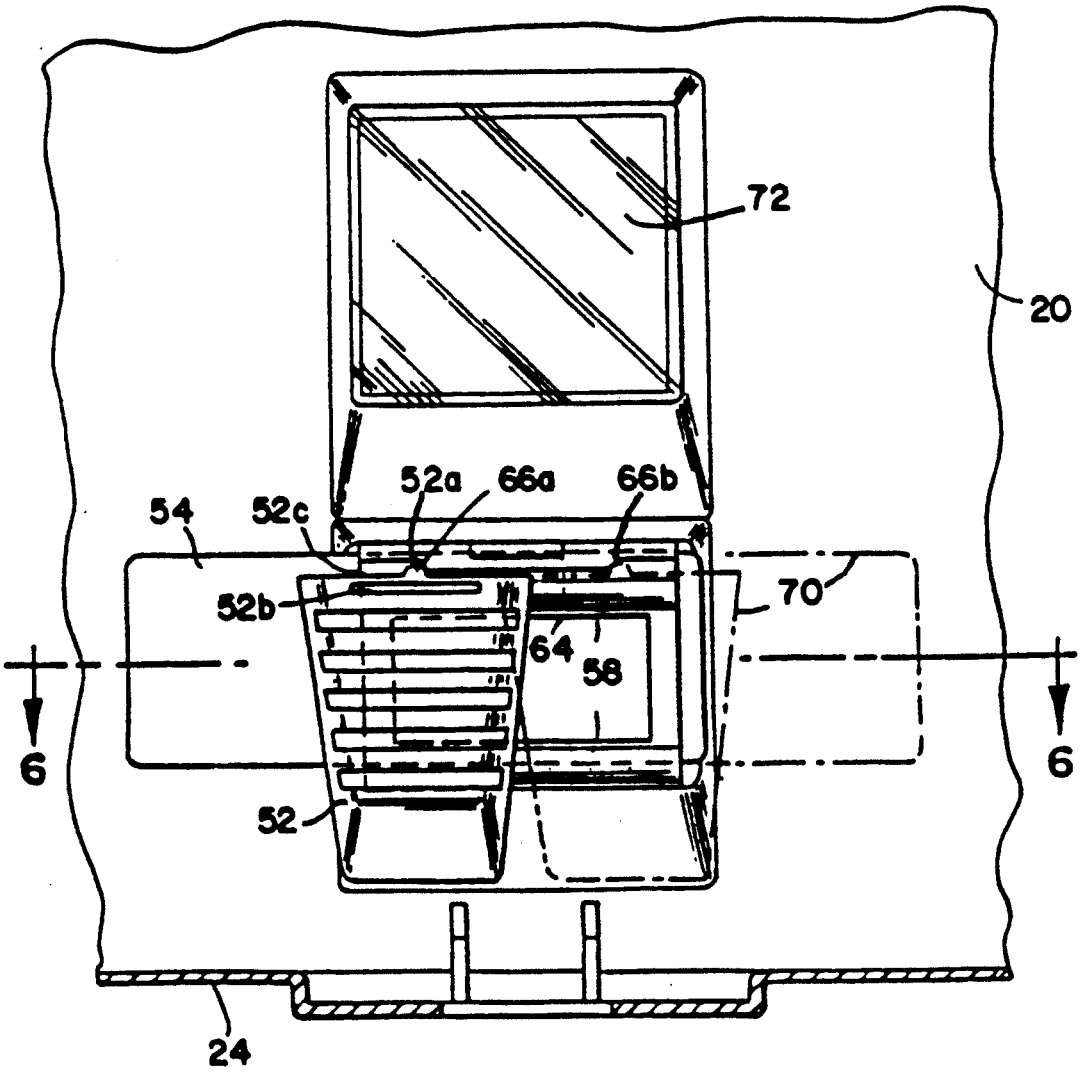
Figure 7:
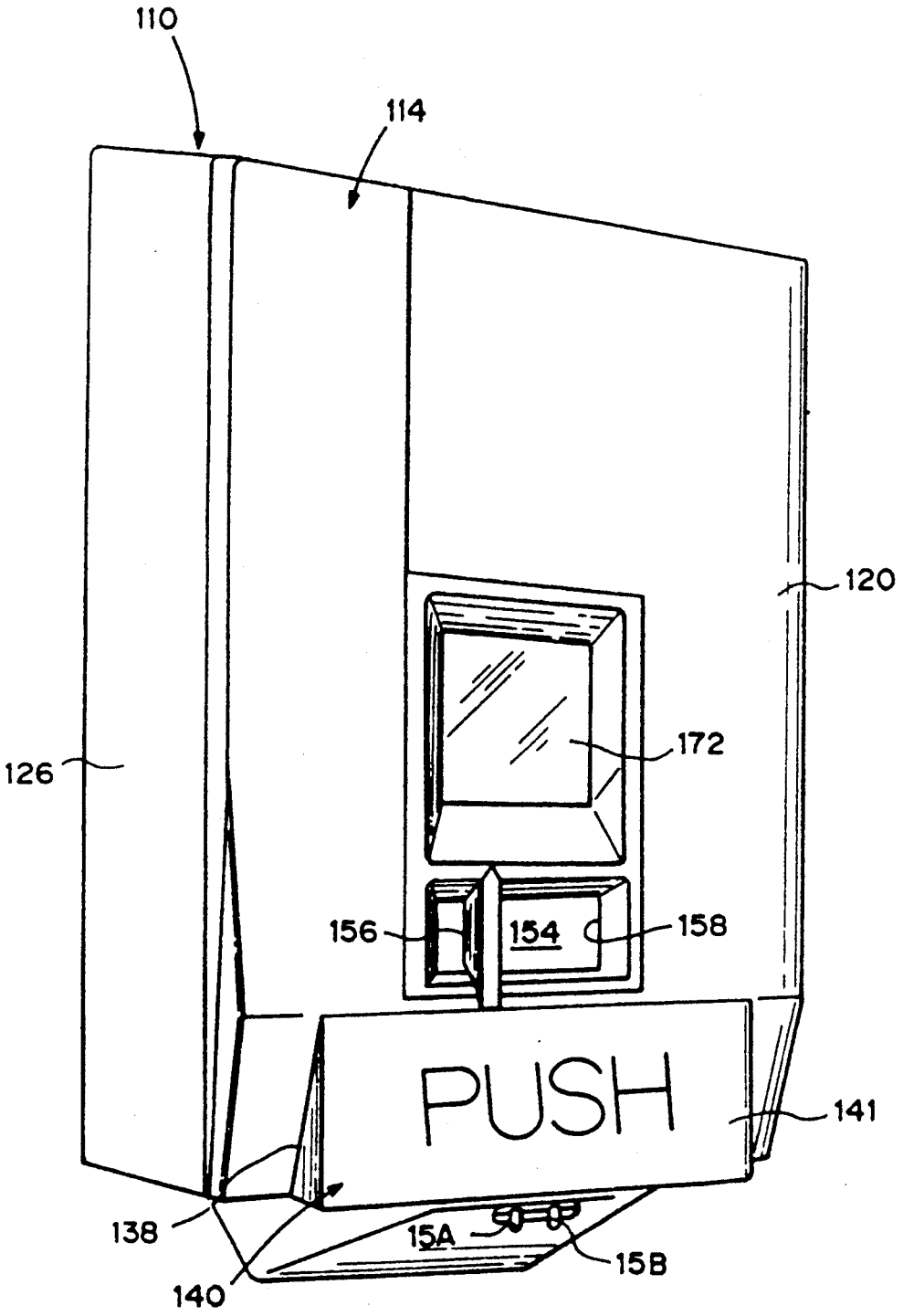
Figure 8:
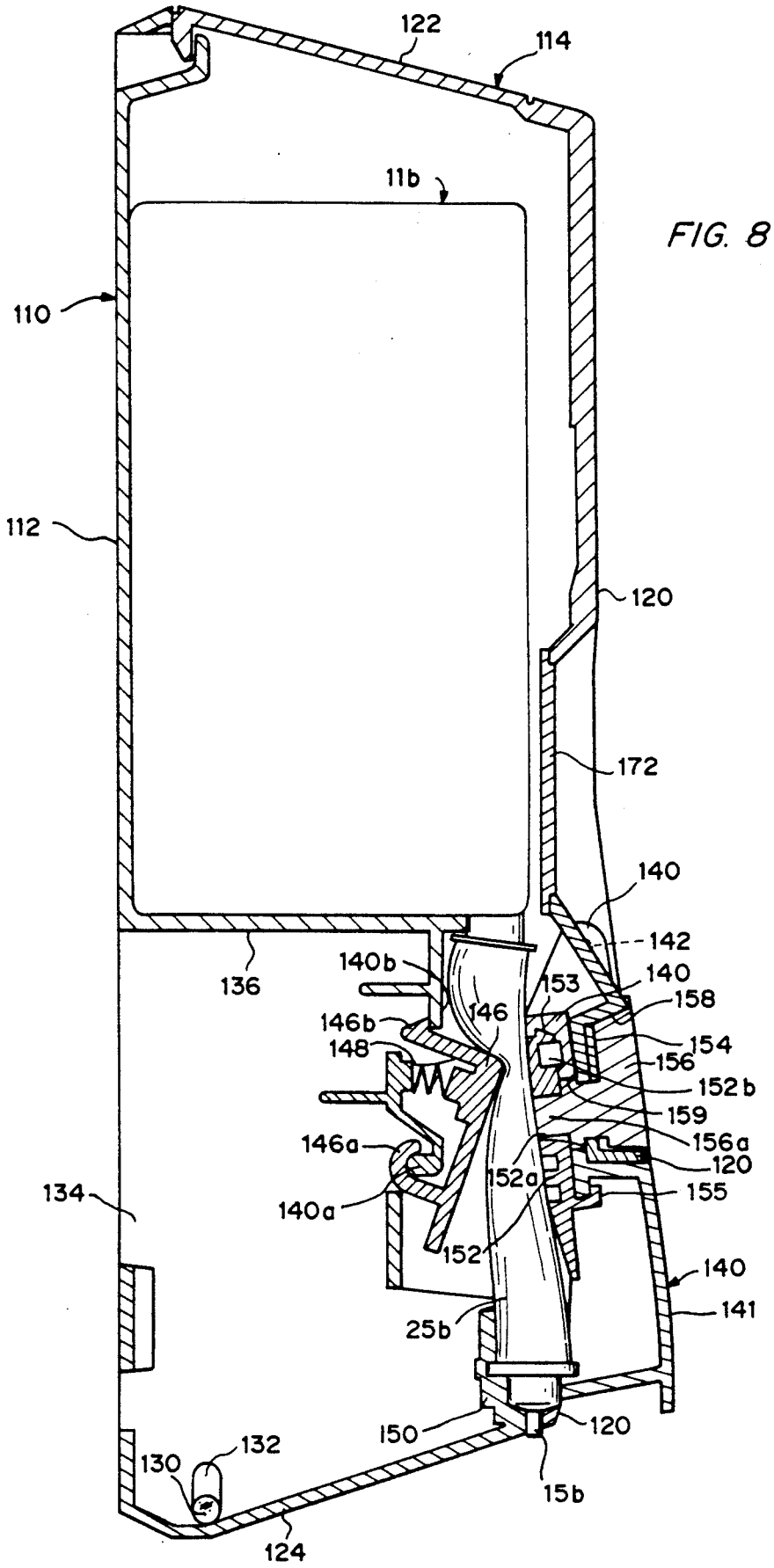
Figure 9:
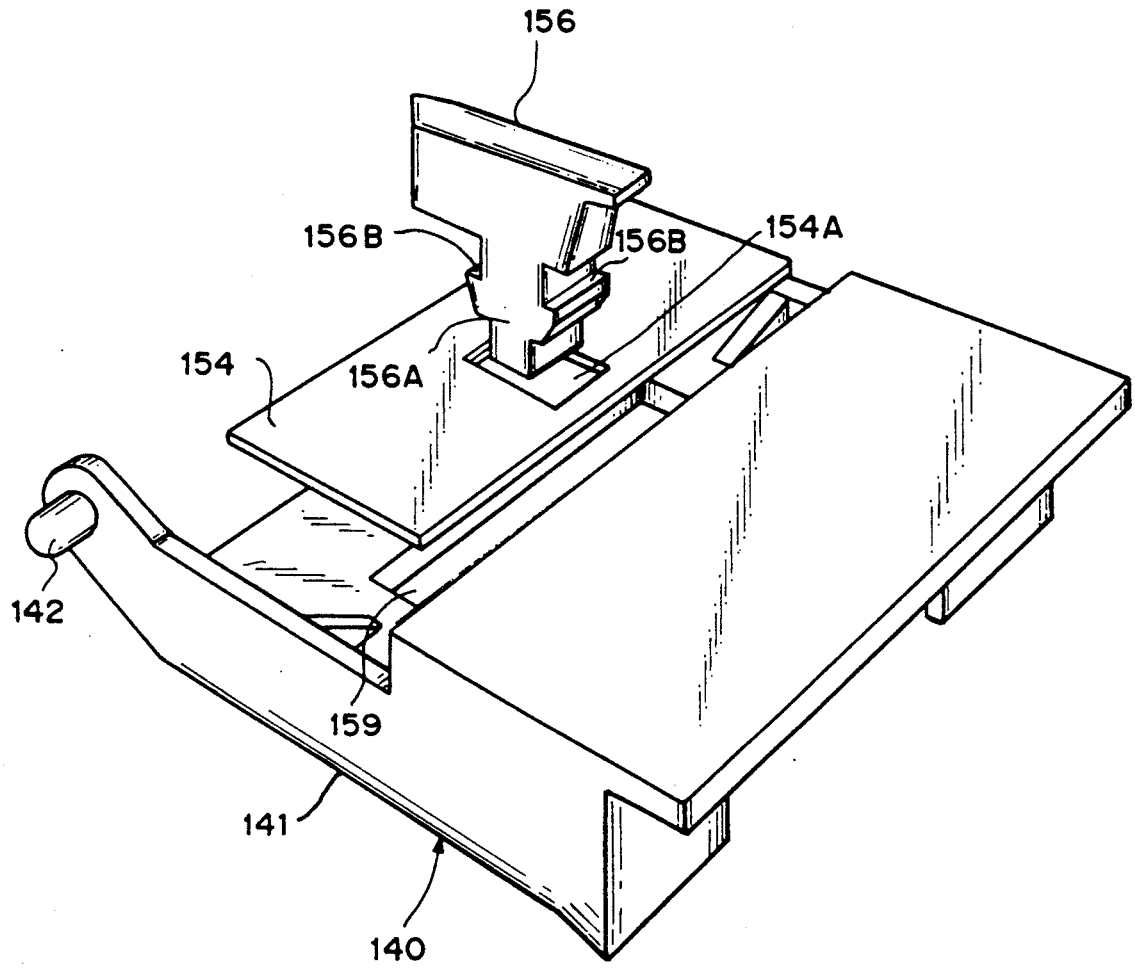
Figure 10:
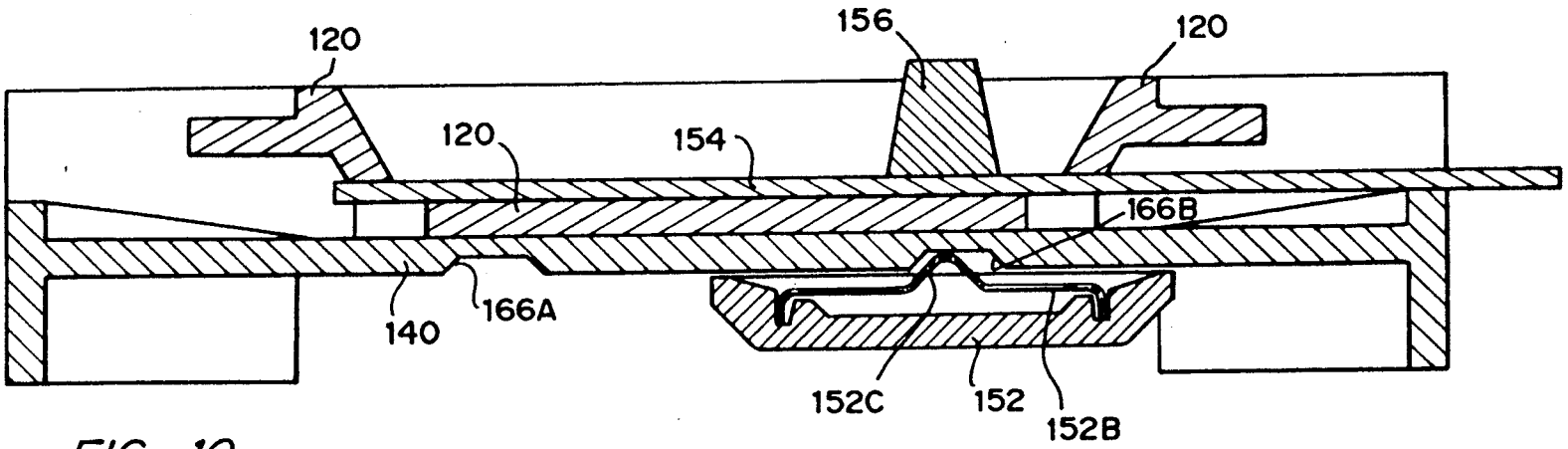
Figure 11:
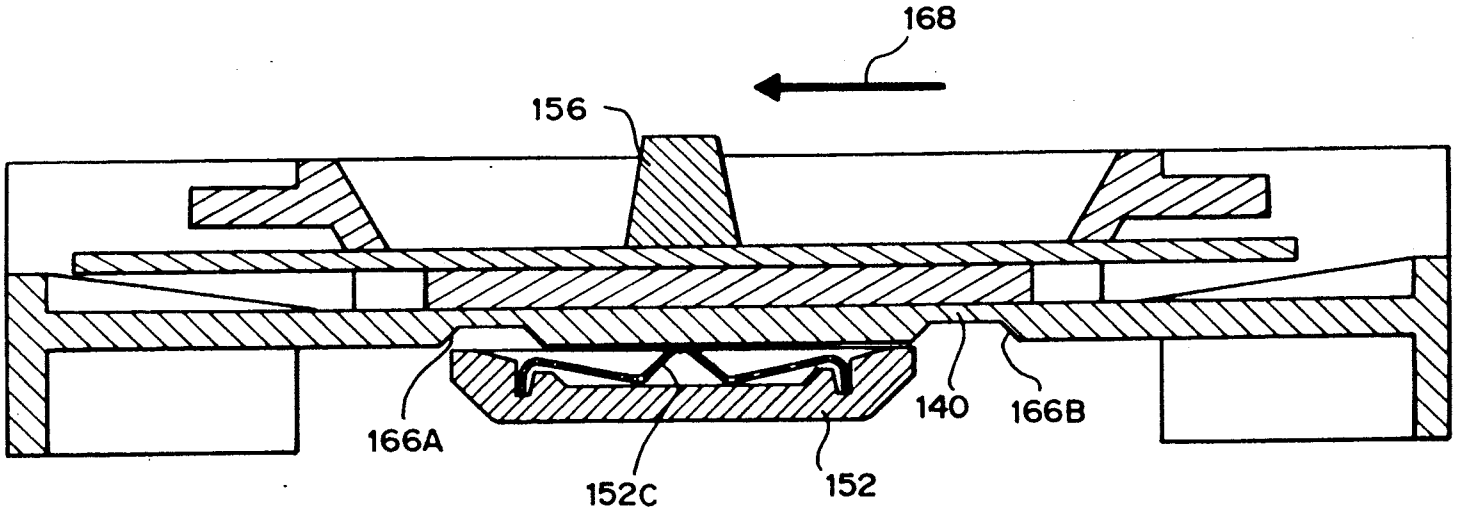
Figure 12:
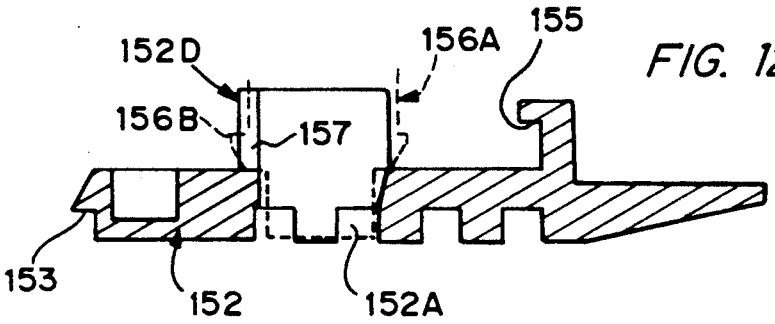
Figure 13:
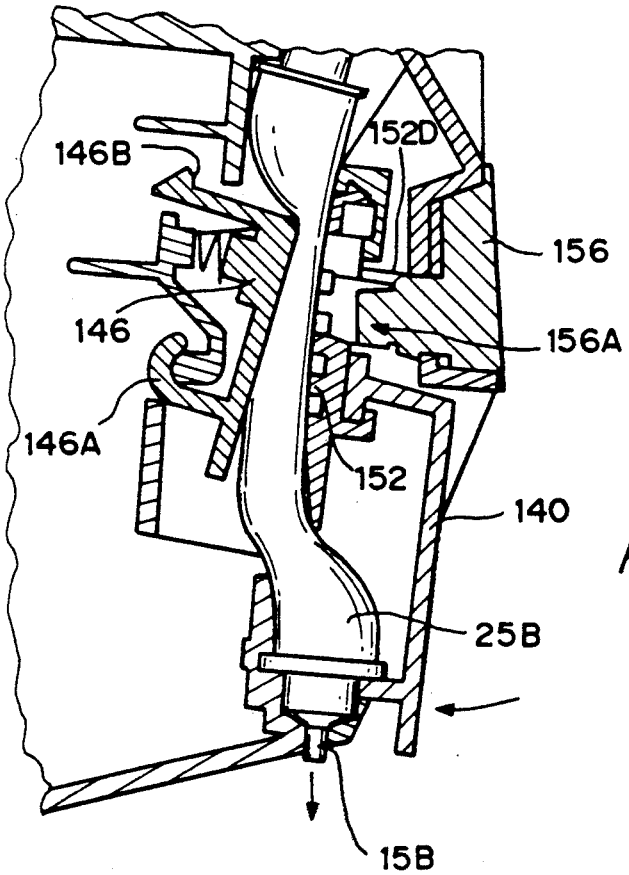

FIG. **4*a*** is a partial sectional side elevation view illustrating the compression of the cartridge pump assembly;

FIG. 5 is a partial sectional view taken along the line 5—5 of FIG. 4;

FIG. 6 is a sectional view taken along the line 6—6 of FIG. 5;

FIG. 7 is a front perspective view of a second embodiment of the dual liquid cartridge dispenser of this invention;

FIG. 8 is a sectional side elevational view of the second embodiment of FIG. 7;

FIG. 9 is a perspective exploded view of a dispensing lever and adjusting knob of the second embodiment;

FIG. 10 is a sectional view taken through a compression member and dispensing lever of the second embodiment, with the compression member disposed in a first position of adjustment;

FIG. 11 is a view similar to FIG. 10 as the knob and compression member are in the process of being slid from the first position of adjustment to a second position of adjustment;

FIG. 12 is a sectional view through a compression member of the second embodiment, with a stem of an adjusting knob depicted in phantom; and FIG. 13 is a fragment of a sectional side elevational view of the apparatus as the dispensing lever is being manually depressed to eject fluid.

SUMMARY OF THE INVENTION

In accordance with the invention there is provided a dispenser that can support two disposable liquid cartridges, each cartridge having an exit orifice through which fluid is dispensed when a pump portion of the cartridge is compressed. The dispenser has a movable dispensing member accessible for manual displacement by a user. A movable compression member is movably mounted on the dispensing member and has (i) a first position adjacent the pump portion of the first cartridge and remote from the pump portion of the second cartridge, and (ii) a second position adjacent the pump portion of the second cartridge and remote form the pump portion of the first cartridge. The movable compression member is connected to a knob extending outside the dispenser which is used to move the compression member to the first position or to the second position in such manner that the compression member is moved out of the first position in response to movement thereof to the second position and vice versa, thereby selecting only a single one of the two cartridges to be compressed. The dispensing member is arranged to compress between the compression member and an opposed pinch surface only that single cartridge pump portion that is adjacent the compression member, thereby causing fluid to be dispensed.

BEST MODES FOR CARRYING OUT THE INVENTION

First Embodiment

For the sake of convenience, an element depicted in more than one figure will retain the same element number in each figure. Referring now to FIG. 1-6, the dispenser 10 of this invention has a rear base member 12, a front face 20, a top wall 22, bottom wall 24 and side walls 26, 28. The base 12 is provided with a number of mounting holes, not shown, so that it can be mounted by means of bolts to a wall behind a washroom sink. In a preferred embodiment, the front wall 20, top wall 22, bottom wall 24, and side walls 26, 28 of the dispenser 10 form a cover 14 that, as best illustrated in FIGS. 4 and 4*a*, is pivotally connected to the base 12 by means of short hinge pins 30 on the cover 14 which extend into pivot holes 32 in support member 34 of base 12. The rear base member 12 and cover 14 form a housing. Also attached to the base 12 is a shelf 36 for supporting two disposable viscous liquid cartridges 11*a* and 11*b*, such as soap or shampoo, side by side in the dispenser 10.

Figure 3:
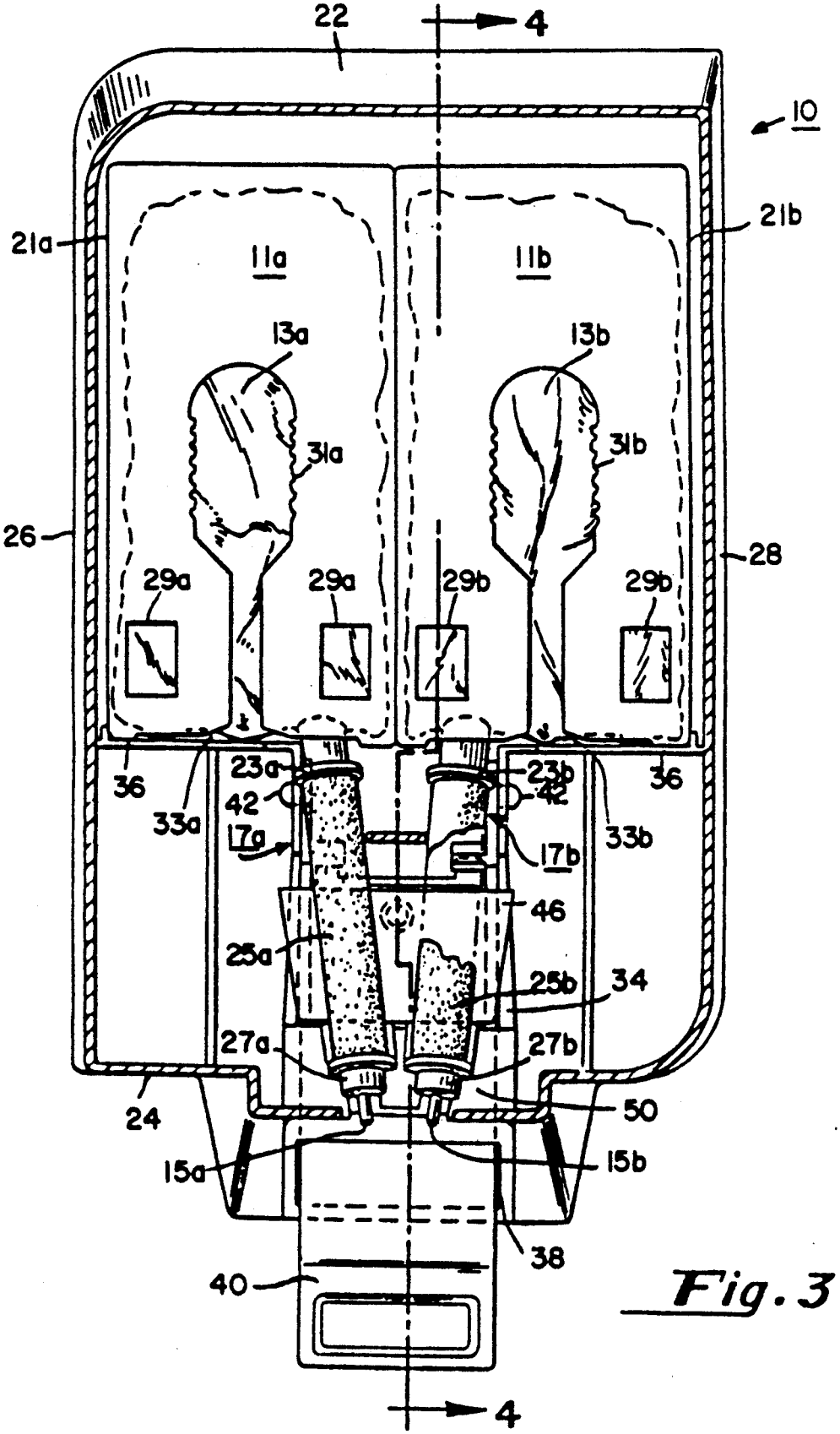
FIG. 3 is a front sectional view taken along the line 3—3 of FIGS. 1 and 4.
Figure 4A:
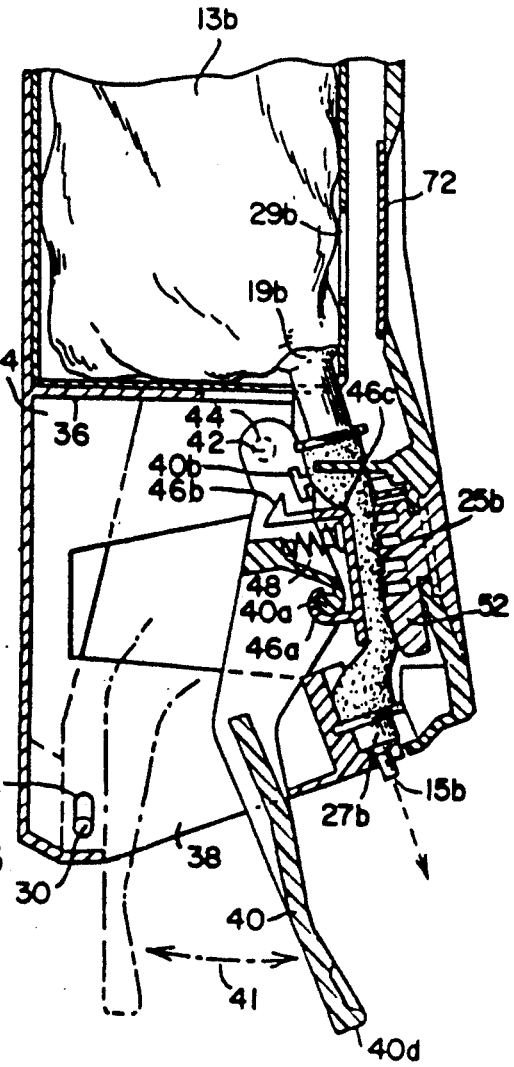

As best shown in FIG. 3, a typical viscous liquid cartridge 11 includes a flexible bag 13, a pump assembly portion 17 and a paperboard box 21 for controlling the shape of the flexible bag 13 both in the dispenser 10 and during shipment. The pump assembly 17 consists of a connector element 23, a flexible tube 25 having one end connected to the connector 23 and the other end connected to a discharge element 27 which includes exit orifice 15 through which the liquid is dispensed. In a preferred embodiment, the discharge element 27 includes a normally closed, spring loaded, ball valve as described in the aforementioned patent to Norman, et al. As best shown in FIGS. 4 and 4*a*, a fitment 19*b* attached to the bottom of the flexible bag 13*b* provides an outlet port through which liquid can flow out assembly 17*b* is inserted into the fitment 19*b* to provide fluid flow from the flexible bag 13*b* into the pump assembly 17*b*. The filled flexible bag 13*b*, and attached pump assembly 17*b* are packaged inside the paperboard box 21*b* for shipment.

Referring now to FIGS. 4 and 4*a*, a handle 40, or dispensing means, is pivotally connected to the base 12 by means of short hinge pins 42 which extend into pivot holes 44 in support member 34 just below the shelf 36. The support member 34 has a central opening 38 and the handle 40 is mounted so that it extends through the central opening 38 with the end 40*d* spaced a short distance below the bottom of the dispenser 10. Assembled to the handle 40 is a spring loaded, pivoted pinch block 46. Pinch block 46 has a pair of hooks 46*a* which fit around a bar element 40*a* of handle 40 so that the pinch block 46 can pivot around the bar element 40*a*. Spring 48 mounted between the handle 40 and the pinch block 46 biases two tabs 46*b* of the pinch block 46 against corresponding stops 40*b* and the handle 40. A spring retaining boss 40*c* on the handle 40 and spring retaining boss 46*d* on the pinch block 46 act to retain the spring 48 within the assembly. Assembled to the lower, front part of support 34 is a discharge element holder 50 into which the discharge elements 27 of two cartridges 11 are held.

Referring now to FIGS. 4, 4*a*, 5 and 6, mounted within the cover 14 is a movable compression block 52. A slide plate 54 is affixed to the compression block 52 and a knob 56 to provide a movable compression means. The upper and lower edges of slide plate 54 move in slide tracks formed between horizontal guide walls 58 and inner surfaces 62 of cover 14. As best shown in FIG. 5, the sloping side 66*a* of ledge 64 cooperate with a raised projection 52*a* on the upper edge 52*c* of compression block 52 to fix the location of the compression block 52 adjacent to the flexible tube 25*b* of cartridge 11*b*. When a force is applied to the knob 56 in the direction of arrow 68, the sloped side 66*a* applies a compressive force to projection 52*a* and, because of slot 52*b*, the upper edge 52*c* of the compression block 52 yields to allow the projection 52*a* to slide along ledge 64. When the movable compression means reaches the position represented by the dashed lines 70, the projection 52*a* rides up the sloped side 66*b* which retains the movable compression block 52 in a second position adjacent the flexible tube 25*a* of the pump assembly 17*a* of the other cartridge 11*a*.

Figure 1:
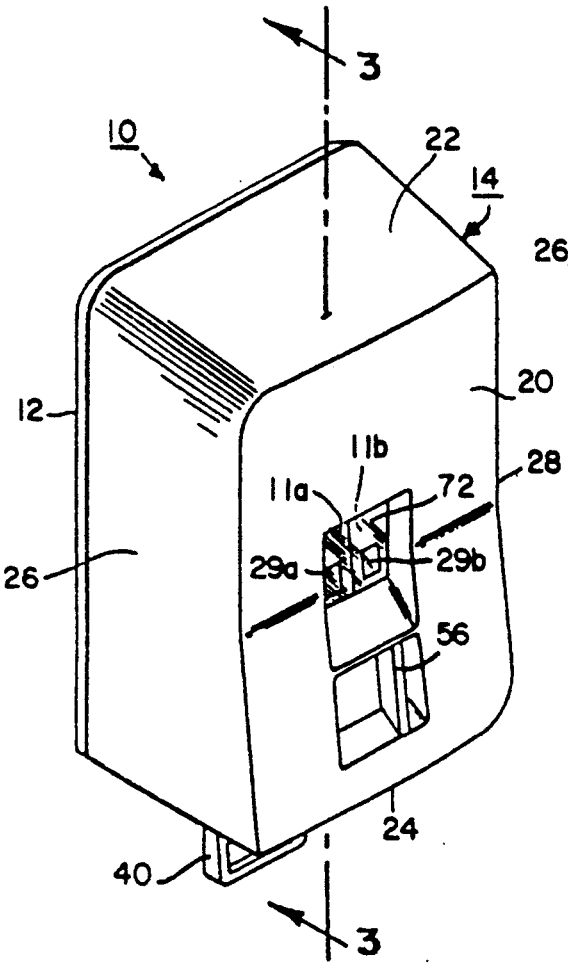
FIG. 1 is a front perspective view of a first embodiment of the dual liquid cartridge dispenser of this invention.
Figure 2:
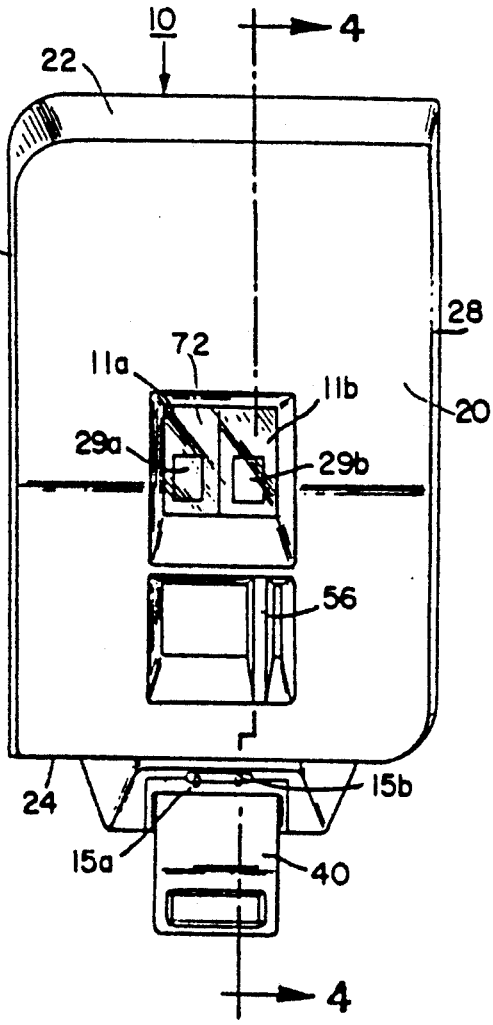
FIG. 2 is a front elevational view of the dispenser.

Referring now to FIGS. 1 and 2, the dispenser 10 has a viewing window 72 located in the center of the front face 20 of the dispenser. The viewing window 72 is located above knob 56 and even with the lower portion of the cartridges 11*a* and 11*b* supported in the dispenser 10. As best shown in FIG. 3, each box 21 has two small rectangular cutouts 29 at the front lower corners of the box 21. When the cartridge 11 is placed in the dispenser 10, the bottoms of the flexible bags 13 of the two cartridges 11 are visible through the viewing window 72.

A typical operating sequence will now be described. The cover 14 is unlocked, or unlatched as the case may be, and pivoted down about hinge pins 30. Spent cartridges 11 are removed and replacement cartridges 11 are prepared by tearing out the vertical front wall strips 31 and the bottom wall strips 33, shown in FIG. 3, from cartridge boxes 21. Removal of those strips 31, 33 allows the pump assemblies 17 to be withdrawn from the boxes 21 so that they extend down from the lower left or lower right portion of the box 21 depending upon whether the cartridge 11 is placed on the support shelf 36 in the left or right position. As best shown in FIG. 4, the rear wall 12 of dispenser 10 has two locating bosses 74 which fit into a locating hole 35 in the cartridge box 21 so that the two cartridges 11*a* and 11*b* are precisely positioned in the dispenser. Locating bosses 74 also prevent shifting of the cartridges 11*a* and 11*b* in the dispenser 10 when replacing cartridges. The discharge element 27 of each cartridge 11 is placed into the discharge element holder 50. As best shown in FIG. 3, when the discharge elements 27*a* and 27*b* of the cartridges 11*a* and 11*b* are fixed in place, the bores of the discharge orifices 15 make a slight angle with the vertical so that fluid discharged from the orifices 15 is directed toward a common point at the same level as lower edge 40*d* of the handle 40.

The cover 14 is now pivoted upward to close the dispenser 10. With the knob 56 placed to the right as shown in FIG. 2, the movable compression block 52 will be located adjacent the pump assembly 17*b* of cartridge 11*b*. Dispensing of the fluid from cartridge 11*b* commences by a user placing his hand palm upward with this fingertips behind the handle 40 and moving handle 40 in the direction indicated by arrow 41 in FIG. 4. As handle 40 is moved to the position indicated in FIG. 4*a*, pinch surface 46*c* of pinch block 46 first pinches the upper portion of flexible tube 25*b* against compression block 52 to seal the tube 25*b* and prevent any back flow of fluid from the lower portion of pump assembly 17*b* into the flexible bag 13*b*. Once the upper portion of the flexible tube 25*b* has been pinched off, further forward motion of handle 40 results in pinch block 46 rotating about bar 40*a* and compression of spring 48 so that pinch block 46 builds up fluid pressure in the lower part of pump assembly 17*b* thereby causing fluid to be expelled through the exit orifice 15*b* into the palm of the user.

When the user releases the handle 40, spring 48 returns the pinch block 46 to the biased position with tabs 46*b* of pinch block 46 in contact with stop surfaces 40*b* of handle 40 which causes handle 40 to be returned to the position shown in FIG. 4. As best shown in FIG. 6, when the movable compression block 52 is positioned adjacent the flexible tube 26*b* of cartridge 11*b* there is a space 76 between the flexible tube 25*a* of cartridge 11*a* and the nearest inside wall of cover 14. The space 76, which is the thickness of movable compression block 52, is such that the forward motion of the pinch block surface 46*c* cannot completely pinch off the flexible tube 25*a* of cartridge 11*a* and will not cause fluid to be dispensed from cartridge 11*a*. When a user observes that cartridge 11*b* is empty, he can move knob 56 in the direction of arrow 68 in FIG. 6 to position the compression block 52 adjacent flexible tube 25*a* of cartridge 11*a*. Dispensing from cartridge 11*a* can now take place. When the maintenance person comes to service the dispenser 10, he will observe through the window 72 that the cartridge 11*b* is empty and can replace it with a new cartridge 11*b*.

Second Embodiment

The second embodiment of the invention is similar to the first embodiment, except that the compression block is mounted on the dispensing member. In that second embodiment depicted in FIGS. 7–13, a dispenser 110 has a rear base 112, a front face 120, a top wall 122, bottom wall 124, and two side walls 126 (only one shown). The base 112 is provided with a number of mounting holes (not shown) so that it can be mounted by means of bolts to a wall behind a washroom sink. Preferably, the front, top, bottom, and side walls 120, 122, 124, 126 form a cover 114 which is pivotably connected to the base 112 by means of short hinge pins 130 on the cover 114 which extend into pivot holes in support member 134 of base 112.

Two viscous cartridges 11 are disposed on a shelf 136 of the base. The cartridges are identical to those earlier disclosed and thus, each cartridge includes a flexible tube 25 connected to a discharge element which includes an exit orifice 15.

A push-type dispensing lever 140 is pivotably connected to the cover 114 by means of short hinge pins 142 which extend into pivot holes in the side walls 126 of the cover 114. The front wall 120 of the cover has an opening 138 therein, and the dispensing lever 140 extends movably therethrough so that a front surface 141 thereof is accessible to a user.

Assembled to the base 112 is a spring loaded, pivoted pinch block 146. The pinch block 146 has a pair of hooks 146*a* (only one depicted) which fit around a bar element 140*a* of the base 112 so that the pinch block 146 can pivot around the bar element 140*a*. A spring 148 mounted between the base 112 and the pinch block 146 biases two tabs 146*b* (only one being depicted) of the pinch block against corresponding stops 112*b* on the base. Assembled to the lower, front part of the support 134 is a discharge element holder 150 in which are held the discharge elements 127 of the cartridges 11.

Mounted on the cover 114 is a movable compression block 152. Extending loosely into a recess 152*a* of the compression block 152 is a stem 156*a* of a knob 156. The stem 156*a* also extends through a hole 154*a* of a slide plate 154, a slot 158 of front wall 120, and a slot 159 of the dispensing lever 140. The arrangement is such that the knob 156 and the slide plate 154 are slidable together relative to the dispensing lever 140. Ears 156*b* formed on the stem 156*a* slidably engage an inside surface of the front wall 120 to retain the knob within the slot 158. The compression block 152 carries guide ledges 153, 155 (FIG. 8) which slidably engage cooperating rails of the dispensing lever to slidably guide the compression block 152 thereon.

The compression block 152 carries a spring strip 152*b* (FIG. 10) which includes a projection 152*c*. The projection 152*c* is selectively receivable within spaced recesses 166*a*, 166*b* of the lever 140. The spring strip is elastically yieldable such that the projection 152*c* can be cammed out of the respective recess 166*a*, 166*b* when the compression block 152 is caused to slide in response to application of a force to the knob 156 (see FIG. 11). The projection then re-enters the other recess at the end of the sliding stroke. The compression block 152 can thus be placed in either of two operating positions relative to the base 112, the cover 114, and the dispensing lever 140.

The compression block 152 further includes a guide sleeve 152*d* (FIG. 12) which surrounds an outer side of the hole 152*a* and extends outwardly therefrom. One side of the sleeve 152*d* includes a slot 157 into which one of the ears 156*b* of the stem 156*a* extends as depicted in FIG. 12. The sleeve 152*d* aids in keeping the compression block 152 mounted on the stem 156*a*, as will be explained hereinafter.

The dispenser has a viewing window 172 located in the front wall 120 above the knob 156 and even with the lower portions of the soap cartridges 11 in the same manner as the earlier described window 72.

IN OPERATION, the dispenser 110 is loaded with soap cartridges in the same manner as described earlier herein. To dispense fluid from a cartridge, a user pushes against the front surface 141 of the dispensing lever 140. This causes the lever 140 to pivot inwardly relative to the front wall 120 in a manner pushing the compression block 152 inwardly relative to the stem 156*a* of the knob 156. The compression block 152 does not travel completely off the stem due to the presence of the guide sleeve 152*d*. The upper portion of the flexible tube 52*b* is initially pinched between the pinch block 146 and the compression block 152 to seal the tube 152*b* and prevent any back flow of fluid. Further displacement of the dispensing lever 140 results in the pinch block 146 rotating about the bar 140*a* against the bias of the spring 148 so that fluid pressure is built-up in the lower part of the tube 52*b*, thereby causing fluid to be expelled therefrom.

When the user releases the handle 140, the spring 148 returns the pinch block 146 to the initial position (FIG. 8) which also causes the compression block 152 and the lever 140 to be returned to the initial position. As will be appreciated, the dispensing operation is similar to that described earlier herein connection with FIGS. 1–6.

When a user observes that one of the cartridges 11*b* is empty, he or she can slide the knob 156 in the direction of arrow 168 in FIG. 11. Due to the presence of the sleeve 156*a* in the hole 152*a* of the compression block 152, the compression block 152 will be caused to slide along with the knob 156 to a position in front of the tube of the other cartridge, and remote from the tube 52*b* of the cartridge 11*b*. During this sliding of the compression block 152, the projection 152*c* of the spring 152*b* will be cammed out of the recess 166*b* and will snap into the recess 166*a*. Thus, further activation of the lever 140 will produce compression only of the tube associated with the other cartridge.

While the present invention has been described with reference to a specific embodiment thereof, it will be obvious to those skilled in the art that various changes and modifications may be made without departing from the invention in its broader aspects. The principles of this invention can be used in dispensers for cartridges 11 that have a pump portion 17 that require only compression to cause dispensing of the fluid.

It is contemplated in the appended claims to cover all variations and modifications of the invention which come within the true spirit and scope of the invention.

What is claimed is:

1. An apparatus for dispensing a viscous liquid from two disposable cartridges, each cartridge having an exit orifice through which fluid is dispensed when a pump portion of the cartridge is compressed by a user, the apparatus comprising:

a housing;

means in the housing for supporting the two cartridges;

a movable dispensing member movably mounted to the housing and accessible for manual displacement by a user;

a moveable compression member movably mounted on the portion of the second cartridge, and having a second position adjacent the pump portion of the second cartridge and remote from the pump portion of the first cartridge; and a knob extending outside the housing and connected to the compression member for moving the compression member to the first position or to the second position in such manner that the compression member is moved out of the first position in response to movement thereof to the second position and vice verse, thereby selecting only a single one of the two cartridges to be compressed;

the dispensing member being arranged to compress between the compression member and an opposed pinch surface in the housing only that single cartridge pump portion that is adjacent the compression member thereby causing fluid to be dispensed from the exit orifice of the selected cartridge.

2. An apparatus according to claim 1, wherein the compression member is movable toward and away from the respective pump portion relative to the knob in response to displacement of the dispensing member.

3. An apparatus according to claim 2, wherein the knob includes a stem, and the compression member includes a hole in which the stem is loosely received.

4. An apparatus according to claim 2, wherein the compression member includes a stem and the knob includes a hole in which the stem is loosely received.

5. An apparatus according to claim 4, further comprising means for retaining the compression member in the first position and the second position.

6. An apparatus according to claim 5, wherein the means for retaining comprises a spring carried by the compression member.

7. An apparatus according to claim 6, wherein said means for retaining further includes at least one recess in the dispensing member which is engageable with the spring.

8. An apparatus according to claim 5, wherein the means for retaining comprises a spring residing between the compression member and the dispensing member.

9. An apparatus according to claim 8, wherein the means for retaining further comprises at least one recess in the compression member engageable with the spring.

10. An apparatus according to claim 1 including means for holding the exit orifices of both tubes so that fluid pumped out of each orifice is directed to a common point below the orifices.

* * * * *